US006000761A

United States Patent [19]

Rocha

[11] Patent Number: 6,000,761

[45] Date of Patent: Dec. 14, 1999

[54] INFANT SUPPORTING CHAIR

[76] Inventor: Karen Eileen Rocha, 2018 Federal, Kansas City, Kans. 66103

[21] Appl. No.: 09/148,227

[22] Filed: Sep. 4, 1998

[51] Int. Cl.[6] ..... A47D 15/00

[52] U.S. Cl. ..... 297/464; 297/183.1; 297/184.13

[58] Field of Search ..... 297/464, 250.1, 297/256.16, 256.15, 183.1, DIG. 6, DIG. 1, 488, 118, 136, 183.6, 183.7, 184.13; 5/655

[56] References Cited

U.S. PATENT DOCUMENTS

| | | | |
|---|---|---|---|
| D. 366,368 | 1/1996 | McCarthy | 5/655 X |
| 2,588,754 | 3/1952 | Novi | 297/136 |
| 2,845,995 | 8/1958 | Landry | 297/136 X |
| 3,558,186 | 1/1971 | Shore et al. | 297/136 |
| 4,143,915 | 3/1979 | Kamlay | 297/488 |
| 4,750,783 | 6/1988 | Irby et al. | 297/256.16 |
| 5,054,851 | 10/1991 | Chiu | 297/136 |
| 5,310,245 | 5/1994 | Lyszczasz | 5/655 X |
| 5,330,250 | 7/1994 | Reyes | 297/256.16 X |
| 5,407,248 | 4/1995 | Jay et al. | 297/DIG. 6 X |
| 5,660,430 | 8/1997 | Clarke | 297/256.16 X |
| 5,732,999 | 3/1998 | Petrie | 297/488 X |
| 5,800,368 | 9/1998 | Klingemann et al. | 5/655 X |

*Primary Examiner*—Milton Nelson, Jr.
*Attorney, Agent, or Firm*—Hovey, Williams, Timmons & Collins

[57] ABSTRACT

A chair (10) utilizes a perimeter wall (12) having an internal chamber (14) and an internal member (16) held in the internal chamber (14) to define an internal seating area (18). The internal member (16) is positioned to provide support for an infant's chest and thereby inhibit forward movement. The perimeter wall (12) includes a back wall (22), a pair of spaced apart side walls (24,26) and a front wall (28). The side walls (24,26) and the back wall (22) are positioned to inhibit lateral and backward movement, respectively. The perimeter wall (12) in conjunction with the internal member (16) substantially surrounds and supports an infant in a seated, upright position.

19 Claims, 3 Drawing Sheets

INFANT SUPPORTING CHAIR

BACKGROUND OF THE INVENTION

1. Field of the Invention

This invention relates to the field of infant support devices. More particularly, the invention is concerned with a chair that supports an infant, who is otherwise unable to sit up unassisted, in an upright seated position.

2. Description of the Prior Art

While parents with young children perform the various tasks required around the home, for example cooking dinner or cleaning, they need a place to put a child where the child is both safe and entertained. To that end, many devices, such as high chairs or walkers, have been developed for holding a child in a seated position, but many infants, who cannot yet sit on their own or who frequently fall over while sitting, are unable to use these devices because they do not support the chest area of a child unable to sit alone. Further, these devices do not support an infant's legs, leaving them to dangle. These devices are especially troublesome to a child that cannot bend his or her knee if, for example, the child's leg is in a cast. These devices can also be expensive, heavy, and difficult to transport.

Other devices are designed especially for infants, but these devices do not support infants in upright seated positions. Bouncers, for example, recline the infant. While the reclining bouncer holds the infant securely, it restricts an infant's viewable area and fails to provide a playing surface. The infant's ability to interact with other persons in the room is limited, as is the infant's ability to play with any items that are not suspended above the bouncer.

SUMMARY OF THE INVENTION

The present invention solves the problems mentioned above and provides a distinct advance in the state of the art. In particular, the infant chair hereof includes an upright perimeter wall and an internal member positioned within the perimeter wall to define an open, internal seating area in which an infant, that is otherwise unable to sit up unassisted, is supported in a seated position. The infant chair also supports the infant's legs, and the internal member supports the infant's chest. Because the infant is in a seated position, his or her viewable area is not restricted, and a playing surface is provided by the internal member thereby expanding the infant's ability to play.

In preferred forms, the perimeter wall and internal member are made from a soft, comfortable material such as polyurethane foam. The internal member can be removable from the internal chamber and include a support edge comprising a teething material. The internal member provides a top play surface that can also include an upper recess comprising plastic or fabric configured to form or hold a bowl. Preferably, a base is attached to the lower margins of the perimeter wall, thereby providing a bottom for the chair, and in one embodiment, a front wall and the internal member are unitary and attached to the base and sidewalls by VELCRO® allowing the front wall and internal member to be removed. With the front wall and internal member removed, the base, sidewalls, and back wall form a chair for a more developmentally advanced child. The perimeter wall is sufficiently thick to stabilize the chair, and support legs can be attached to the base to provide additional stability. Further, an infant support cushion can be placed within the internal seating area to provide additional support and stability for a smaller infant.

BRIEF DESCRIPTION OF THE DRAWINGS

A preferred embodiment of the present invention is described in detail below with reference to the attached drawing figures, wherein.

DETAILED DESCRIPTION OF THE PREFERRED EMBODIMENT

Figure 2:
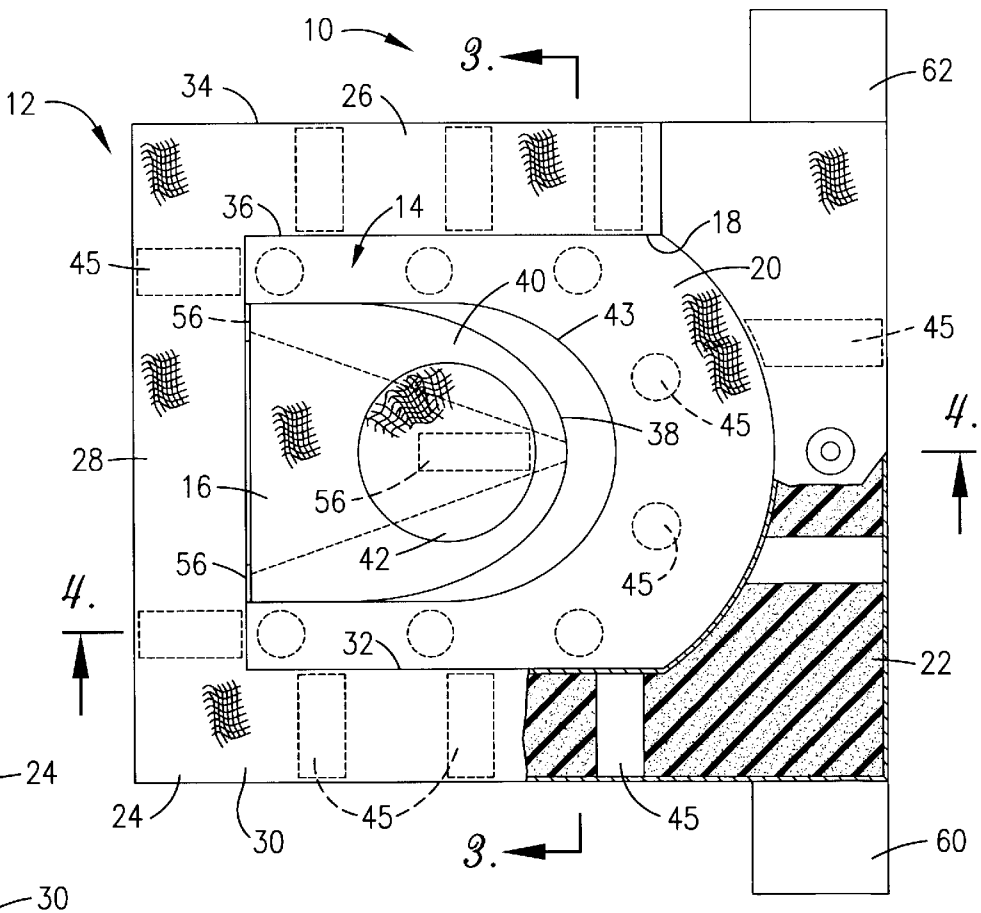
FIG. 2 is a top view in partial cross section of the chair shown in FIG. 1.
Figure 1:
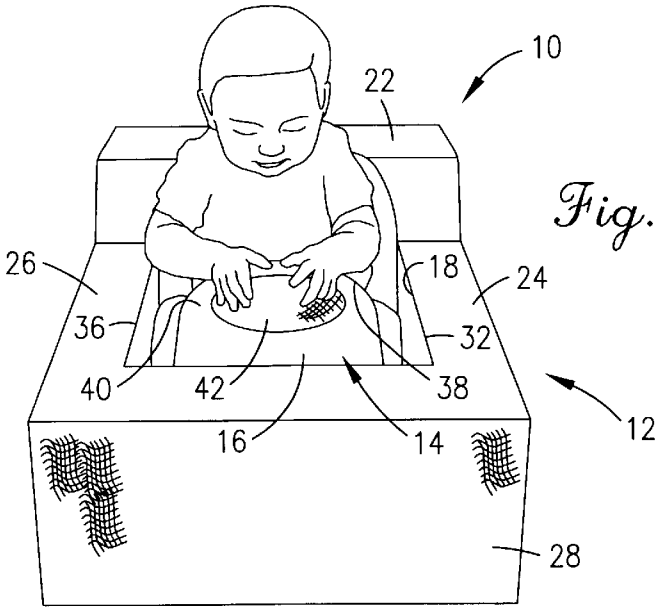
FIG. 1 is a perspective view of an infant seated in a chair according to the present invention.

The drawing figures illustrate a chair 10 constructed in accordance with a preferred embodiment of the present invention. Referring initially to FIGS. 1–2, the chair 10 includes a perimeter wall 12, an internal chamber 14, an internal member 16, an internal seating area 18 and a base 20. The perimeter wall 12 and internal member 16 are connected to support an infant in an upright, seated position within the seating area 18. The perimeter wall 12 surrounds and defines the internal chamber 14, and the internal member 16 is situated within the internal chamber 14 to define the open, internal seating area 18.

Figure 3:
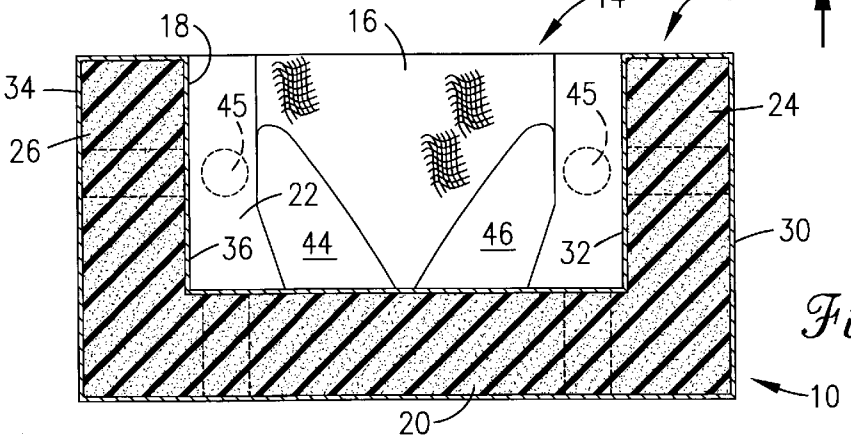
FIG. 3 is a transverse cross-sectional view of the chair of FIG. 1 taken along line 3—3 in FIG. 2.

As shown in FIGS. 1–3, the perimeter wall 12 is substantially upright and includes a back wall 22, side walls 24, 26, and front wall 28 in a substantially rectangular configuration. Thus, the side walls 24, 26 are parallel to each other and perpendicular to the front 28 and back walls 22 which are also parallel to each other. Further, the side walls 24, 26 are spaced apart from each other, and the front 28 and back walls 22 are spaced apart to define the internal chamber 14 within the perimeter wall 12. The back wall 22 is taller than the front 28 and side walls 24, 26 and has a height sufficient to support an infant's head and shoulders, inhibiting movement in the rearward direction. The back wall 22 connects to rear margins of the side walls 24, 26 in a spanning relationship therewith. The side wall 24 has a thickness defined by an outer side 30 and an inner side 32. The side wall 26 has a thickness defined by an outer side 34 and an inner side 36. The outer sides 30, 34 are spaced apart by an outer distance selected to provide stability for the chair during lateral movement by an infant, and the inner sides 32, 36 are spaced apart by an inner distance selected to inhibit an infant's lateral movement. The side walls 24, 26 may also be tapered to increase the chair's stability. If tapered, the lower margins of the side walls 24, 26 are thicker than the upper margins, without changing the distance between the inner sides 32, 36. The front wall 28 connects to the front margins of the sidewalls 24, 26 in a spanning relationship therewith, so that the perimeter wall 12 is substantially continuous.

The internal member 16 includes an arcuate supporting edge 38, a half oval, top play surface 40, upper recess 42, and a pair of concave sides 44, 46. The internal member 16 is preferably attached to the front wall 28 and the base 20 but can attach to only one of the front wall and base. The front wall 28 and internal member 16 together form a front of seat 10. The concave sides 44, 46 of the internal member in conjunction with the inner sides 32, 36 define infant leg openings. A width of the lower margin of the internal member 16 increases as the distance from the front wall 28 decreases and the internal member 16 is flat where it attaches to the front wall 28. The supporting edge 38 of the internal member 16 faces the infant and engages the infant's chest to stably support the infant in a seated, upright position. Because the supporting edge 38 is positioned near the infant's mouth, it is preferably covered with a teething material. The top play surface 40 of the internal member 16 preferably includes an upper recess 42 to receive a bowl. The upper recess 42 can also be lined with plastic to form a bowl.

The internal member 16 can also be provided with an extension 43 which would attach with VELCRO® adjacent the supporting edge 38. The extension 43 is attached to the internal member 16 for smaller infants. The outer edge of the extension 43 engages the chest of the infant to support the infant in a seated position. The extension can be used with the support cushion 47 (to be discussed below) or as an alternative thereto.

The internal seating area 18 is defined by placement of the internal member 16 within the internal chamber 14 defined by the perimeter wall 12, and the seating area is sized at least large enough to receive an infant. From a top view the internal seating area 18 is arch shaped. The legs of the arch are the leg openings, and the top of the arch receives the infant's torso. The cross sectional area of each leg opening decreases as distance to the front wall 28 decreases and as distance to the top play surface 40 decreases. Thus, the internal member decreases in cross sectional area in a descending direction along a vertical axis.

The base 20 connects to the lower margins of the perimeter wall 12 and provides a bottom of the internal seating area 18, substantially closing the bottom of the internal seating area 18. Polyurethane foam can be used to form the base 20, and a waterproof or stain resistant fabric cover enwraps and protects the underlying material. The base 20 can be integrally formed with the perimeter wall 12 or be removably attached to allow for cleaning. In a preferred embodiment, the perimeter wall 12, internal member 16, and base 20 are integrally formed of polyurethane foam. Polyurethane foam is preferred for softness, light weight and low cost.

The chair 10 is preferably covered with fabric. The fabric can have a waterproof backing or be treated for stain resistance. Preferably, the fabric cover can be removed for cleaning purposes. The perimeter wall 12 and base 20 can have holes 45 approximately every four inches to provide ventilation for the infant. A preferred embodiment of the chair 10 further includes a handle (not shown) attached to the perimeter wall 12. The handle can also be formed by hollowing out a rectangular opening in the perimeter wall. A reinforcing member preferably protects the rectangular opening from damage.

Figure 7:
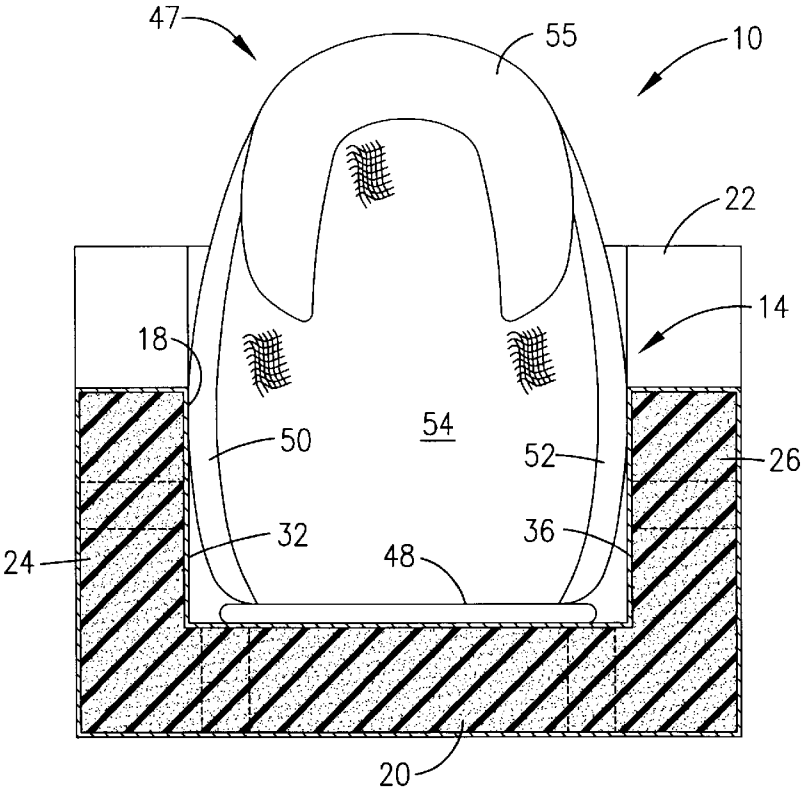
FIG. 7 is a transverse cross-sectional view of the chair of FIG. 1 further illustrating the front view of the support cushion shown in FIG. 6.
Figure 6:
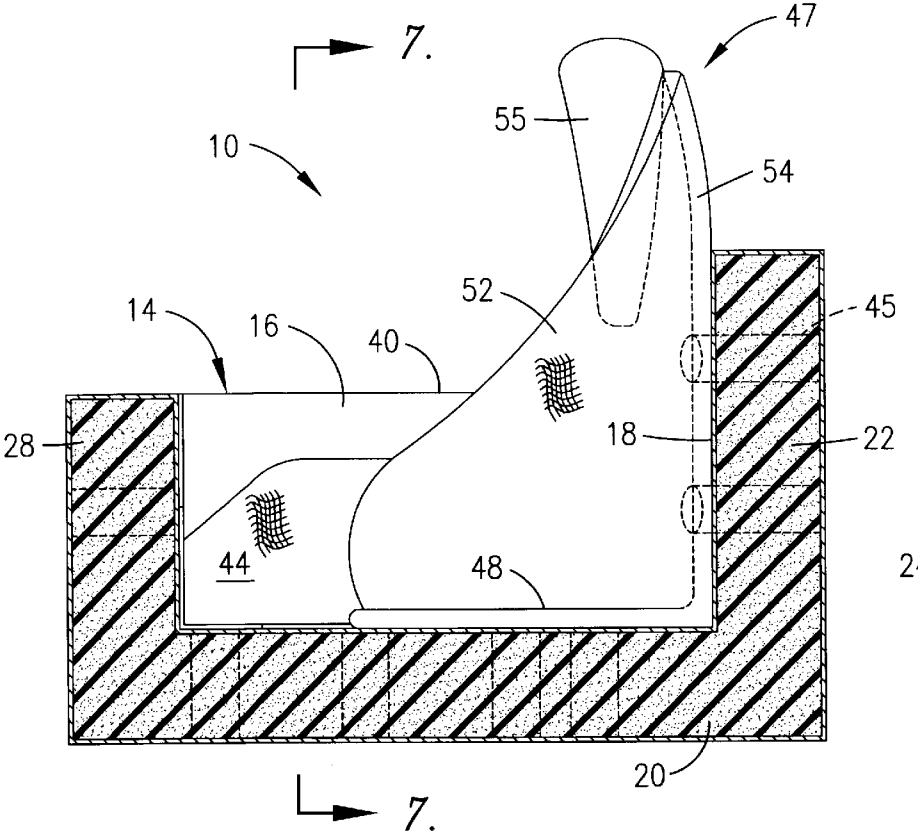
FIG. 6 is a lateral cross-sectional view of the chair of FIG. 1 illustrating a side view of a support cushion placed in the chair.

Referring to FIGS. 6 and 7, additional support necessary for smaller infants can be provided by a support cushion 47. The support cushion 47 includes a seat 48, arms 50, 52, base 54 and top 55. The base 54 connects the seat 48, top 55 and the arms 50, 52 while providing support for an infant's head and shoulders. The seat 48 boosts a smaller infant to a position where the internal member 16 engages the infant's chest stably supporting the infant. The arms 50, 52 support a smaller infant's torso and shoulders comfortably inhibiting lateral movement. The top 55 is preferably removable from the cushion and supports an infant's head preventing over-extension of his or her neck. The support cushion 47 attaches to the perimeter wall 12 and base 20 by VELCRO® or another fastening method. The fabric used to cover the chair 10 will also preferably be used to cover the support cushion 47.

Figure 5:
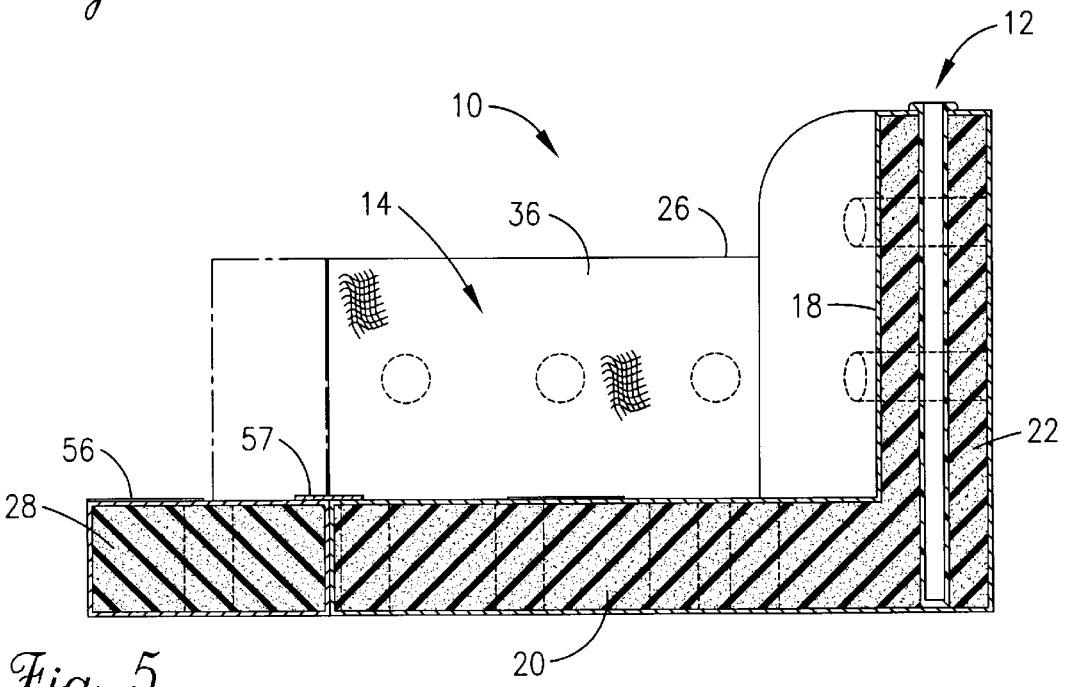
FIG. 5 is a lateral cross-sectional view of an alternate embodiment of the chair having a hingedly attached front according to the present invention.

Referring to FIGS. 2 and 5, the internal member 16 is preferably removable. The internal member 16 is attached to the front wall 28 and bottom 20 by VELCRO® 56 or another fastening method, and the front wall is hingeably attached to the base 20 by hinges 57. The hinges 57 are preferably cloth and incorporate VELCRO® connections on one side, so that the front wall 28 can be removed from the base 20. The base 20 does not extend beyond the front margins of the side walls 24, 26 and the front wall 28 does not extend beyond the lower margins of the side walls 24, 26, leaving room for the front wall 28 to pivot into position. The thickness of the front wall 28 and the base 20 are substantially the same allowing for the front wall 28 to be flipped down about the hinges providing a flush surface thereby making a small bed for an infant. VELCRO® fasteners (not shown) are used to hold the front wall 28 in the upright position. With the front wall and internal member attached to the base and sidewalls by VELCRO® fasteners and hinges 57, the front wall and internal member can be removed so that the base, side walls, and back wall form a chair for a larger child.

Figure 4:
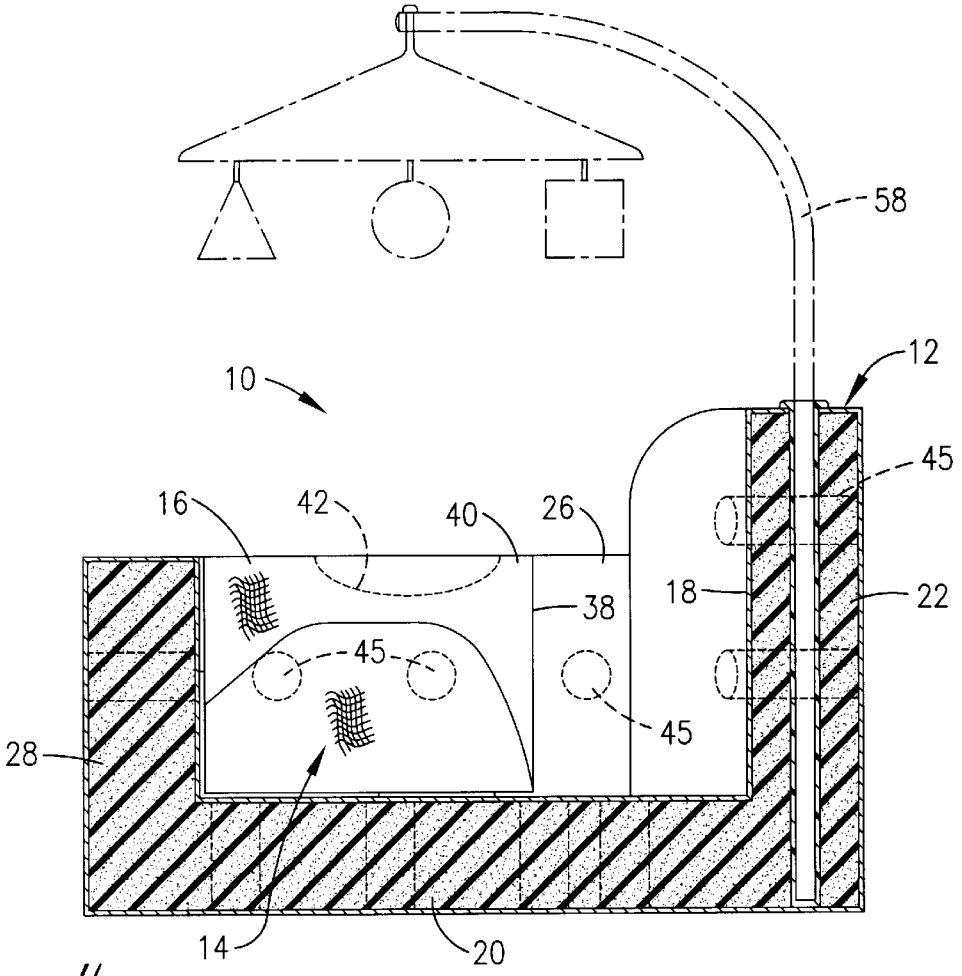
FIG. 4 is a lateral and staggered cross-sectional view of the chair of FIG. 1 taken along line 4—4 in FIG. 2.

Referring to FIGS. 2 and 4, the chair can include a toy bar 58, which suspends toys within easy reach of an infant, and the side walls 24, 26 contain a cupholder for a bottle or infant's cup. The chair 10 can also include legs 60, 62 attached to the outer side walls 30, 34 or weights (not shown) inserted into the base 20 to provide increased lateral support, and thereby inhibit tipping. The chair 10 may be placed on a wheeled platform (not shown) for ease in transportation, and for increased infant support, a belt (not shown) can be included by inserting the ends through holes (not shown) in the back wall 22.

Because the invention is lightweight, an adult will be able to lift and transport the chair 10 with ease. The polyurethane foam construction allows an infant to be comfortably supported in an upright, seated position. An infant seated in the chair 10 has extra play area and has very little limitation on its viewable area. In addition, the simple construction from polyurethane foam creates the infant chair 10 at low cost.

In use, the infant is seated in the chair 10 so that his or her legs are supported by the base 20, one on each side of the internal member 16. The side walls 24, 26 support the infant when he or she shifts laterally. The internal member 16 and back wall 22 inhibit the forward or backward movement the infant, and if the infant shifts suddenly, the foam material gently catches the infant. Therefore, the chair 10 safely supports the infant in an upright, seated position and allows him or her to play with toys both suspended and on the play surface within an easy arm's reach.

It is preferred that the present invention is integrally formed of polyurethane foam, but those skilled in the art will appreciate that the present invention encompasses many variations in the preferred embodiments described herein. For example, the perimeter wall 12 could comprise different pieces attached by some type of coupler. Also, the perimeter wall 12 could be a different shape other than rectangular. The preferred embodiment is made of polyurethane foam, but the type of foam or material used could be varied. For example, the chair 10 could also be made of plastic or wood.

Having thus described the preferred embodiments, the following is claimed as new and desired to be secured by Letters Patent:

We claim:

1. An infant chair for supporting an infant in a seated, upright position, the chair comprising:

a substantially upright perimeter wall defining an internal chamber; and an internal member inserted in the internal chamber to define an open, internal seating area within the internal chamber, the internal seating area being sized at least large enough to receive the infant, and the internal member for supporting an infant in the substantially seated, upright position, wherein the interior member and the perimeter wall comprise polyurethane foam, and the internal member includes an edge comprising a teething material.

2. An infant chair for stably supporting an infant, in a seated, upright orientation, the chair comprising:

a pair of spaced apart side walls generally parallel to each other and each sidewall presenting front, lower, and rear margins;

a back wall coupled with the rear margins in a spanning relationship therewith, the back wall extending substantially vertically for holding the infant in a substantially upright position, the back wall presenting a lower margin;

a front coupled with the front margins and presenting a lower margin;

a base coupled with the lower margins of the front, back wall, and side walls to substantially close a bottom of an internal seating area;

the front, back wall, and side walls defining an opening for receiving the infant therein; and the front being positioned to provide support for the infant's chest thereby inhibiting forward movement, the side walls and back wall being positioned to inhibit an infant's lateral and backward movement, respectively, the front, back wall, and side walls being coupled to substantially surround an infant and support an infant in the seated, upright position.

3. The chair according to claim 2 wherein the front comprises a front wall coupled with the front margins of the side walls in a spanning relationship therewith, and an internal member positioned between the sidewalls to support an infant in a seated, upright orientation.

4. The chair according to claim 3 wherein the internal member comprises an upper recess.

5. The chair according to claim 3 further comprising a base coupled with the front, back, and side walls.

6. An infant chair for stably supporting an infant, in a seated, upright orientation, the chair comprising:

a pair of spaced apart side walls generally parallel to each other and each sidewall presenting front and rear margins;

a back wall coupled with the rear margins in a spanning relationship therewith;

a front coupled with the front margins, the front comprises a front wall coupled with the front margins of the side walls in a spanning relationship therewith, and an internal member positioned between the sidewalls to support an infant in a seated, upright orientation;

a base coupled with the front, back, and side walls; and a hinge connecting the front wall to the base allowing the front wall to flip down, and wherein the front wall has a thickness sized so that the front wall is substantially flush with the base when the front wall is flipped down to provide a small bed for an infant, the front, back wall, and side walls defining an opening for receiving the infant therein, the front being positioned to provide support for the infant's chest thereby inhibiting forward movement, the side walls and back wall being positioned to inhibit an infant's lateral and backward movement, respectively, the front, back wall, and side walls being coupled to substantially surround an infant and support an infant in the seated, upright position.

7. An infant chair for stably supporting an infant, not otherwise capable of sitting up, in a seated, upright orientation, the chair comprising:

a substantially upright perimeter wall having a substantially rectangular configuration and defining a substantially rectangular chamber;

a generally half oval internal member inserted in the chamber, the perimeter wall and internal member defining a generally arch shaped, open seating area;

a base coupled with the substantially upright perimeter, the base presenting a substantially flat surface configured for supporting the infant's legs and feet thereon; and the arch shaped seating area including a pair of leg openings to receive an infant's legs and a top opening to receive an infant's torso.

8. The chair according to claim 7 wherein the internal member includes a pair of substantially concave sides defining, at least in part, the pair of leg openings.

9. The chair according to claim 7 further including a handle formed in the perimeter wall.

10. The chair according to claim 7 wherein the internal member comprises a top play surface.

11. The chair according to claim 7 wherein the base is coupled with substantially all of the lower margin of the perimeter wall to substantially close a bottom of the internal seating area.

12. The chair according to claim 7 wherein the internal member, the base, and the perimeter wall comprise an integrally formed structure.

13. The chair according to claim 7 further comprising a support cushion positioned in the internal chamber to provide additional support for a smaller infant's back, head and sides.

14. The chair according to claim 7 wherein the internal member is attached to the perimeter wall by fastening devices comprising hook and loop fasteners.

15. The chair according to claim 7 wherein the internal member and the perimeter wall comprise a soft, lightweight material.

16. The chair according to claim 7 wherein said internal member decreases in cross sectional area in a descending direction along a vertical axis.

17. The chair according to claim 7 wherein the internal member comprises a generally half oval shaped top, and an arcuate portion of the oval shaped top is adapted to be positioned to face an infant seated in the chair.

18. The chair according to claim 7 wherein the perimeter wall includes:

a back wall having a height sufficient to support an infant's head and shoulders;

a pair of spaced apart side walls, the side walls being substantially parallel to each other and substantially perpendicular to the back wall; and a front wall spaced apart from and substantially parallel to the back wall.

19. The chair according to claim 18, wherein each side wall comprises a thickness bounded by an inner side and an outer side, the inner sides are spaced apart by an inner distance selected to inhibit lateral movement of an infant seated therebetween, and the outer sides are spaced apart by an outer distance selected to stabilize an infant and maintain an upright orientation during lateral movement by an infant.

* * * * *